US005197215A

United States Patent [19]

Torsleff

[11] Patent Number: 5,197,215

[45] Date of Patent: Mar. 30, 1993

[54] LABEL HOLDER DEVICE FOR GOODS DISPLAY UNITS

[75] Inventor: Jorgen F. Torsleff, Paris, France

[73] Assignee: Label Plastic Holders, International, Inc., France

[21] Appl. No.: 810,442

[22] Filed: Dec. 18, 1991

Related U.S. Application Data

[63] Continuation of Ser. No. 616,902, Nov. 21, 1990, abandoned.

[30] Foreign Application Priority Data

Nov. 24, 1989 [CH] Switzerland ..... 4225/89

[51] Int. Cl.[5] ..... G09F 3/18

[52] U.S. Cl. ..... 40/642; 40/649

[58] Field of Search ..... 40/649, 642, 661; 211/59.1; 248/225.1, 307, 215

[56] References Cited

U.S. PATENT DOCUMENTS

| | | | |
|---|---|---|---|
| 2,936,904 | 5/1960 | Streater | 40/649 |
| 3,889,408 | 6/1975 | Offner | 40/642 |
| 4,140,224 | 2/1979 | Celeste | 40/642 |
| 4,319,731 | 3/1982 | Pheifer | 248/223.4 |
| 4,485,575 | 12/1984 | Fast | 40/649 |
| 4,531,311 | 7/1985 | Howard et al. | 40/649 |
| 4,591,057 | 5/1986 | Garfinkle | 211/59.1 |
| 4,606,466 | 8/1986 | Fredrickson | 40/649 |
| 4,866,868 | 9/1989 | Kass | 40/661 |
| 4,876,811 | 10/1989 | Peltz | 40/642 |
| 4,881,707 | 11/1989 | Garfinkle | 40/642 |
| 4,899,974 | 2/1990 | Wear et al. | 248/467 |
| 5,044,104 | 9/1991 | Hopperdietzel | 40/649 |

FOREIGN PATENT DOCUMENTS

| | | | |
|---|---|---|---|
| 408628 | 9/1966 | Switzerland | 40/651 |

*Primary Examiner*—James R. Brittain
*Assistant Examiner*—Cassandra Hope
*Attorney, Agent, or Firm*—Laff, Whitesel, Conte & Saret

[57] ABSTRACT

A universal label holder having a plurality of attachments which are functionally designed for different kinds of display units. The label holder has a first assembly extending therefrom that allows a display unit attachment to be connected thereto. Several different display unit attachments each having a second assembly to connect to the first assembly may be used with the label holder. The different display unit attachments also each have fixing part to connect to a display unit. Thus, the universal label support achieves uniform labeling for a group of different display units in the same store.

8 Claims, 3 Drawing Sheets

LABEL HOLDER DEVICE FOR GOODS DISPLAY UNITS

This application is a continuation of application Ser. No. 07/616,902, filed Nov. 21, 1990, abandoned.

FIELD OF THE INVENTION

The present invention relates to a label holder for goods display units.

PRIOR ART

Many types of display units such as shelves, wire baskets, trays, rods, and the like are used in retail stores, such as shops or supermarkets.

Before the 1980s, price labels were rarely put on the edges of display units because each article was marked with a small self-adhesive label. In the 1980s, various laws were passed requiring the displaying of prices per unit (for example price per kg or l) for all foodstuffs. As a consequence unit prices were shown on the display units in addition to the price of the quantity sold shown on the object itself.

In the 1980s, when labeling moved into preprinted so-called "bar code" labels stuck to the packaging, individual manual marking of each article became redundant. This has made it all the more necessary for detailed labeling to be arranged on the display unit of the article.

Many label-display devices designed for specific forms of goods display units have been developed. Patents U.S. Pat. Nos. 4,805,861 and 4,187,159 and FR 2,585,549 disclose label holders which can be fixed to the rods from which blister-packed articles are hung. U.S. Pat. Nos. 4,761,904 and 4,760,660 disclose label-holders which can be fixed to the grid structures of tray containers. Patent FR 2,583,195 and Patent GB 2,167,223 disclose a label holder which fits an edge rail for a shelf. Patent FR 2,565,388 discloses a label holder which fits the angle-bar edges of metal shelves. Patent DE 3,517,323 discloses a label-holder device intended for perforated walls. The diversity of forms of the label holders and labels fixed on the different kinds of display units that may be found in the same store creates a disharmony of presentation in the store as a whole. It also means a loss of time for the staff responsible for labeling who have to be careful not to get the format wrong and have to make new labels every time the goods change shelves.

SUMMARY OF THE INVENTION

The object of the present invention is to allow the uniform and standardized presentation of the labeling of all the shelves in a store which is easy to install and easy to move.

This object is achieved with a label-holder device which comprises:

a label support 1, 1', having means for holding the label in place 2, 3, 2', 3' and a first standardized means of assembly 4*a*, 4*b*, 4*a'*, 4*b'* and at least one fixing part or display device attachment A, B, C, D, E, F a second standardized means of assembly 5, 5', 5'', 5''', $\mathbf{5}^{V}$ which fits said first means of assembly in order to connect said label support to said fixing part, and fixing means 6, 6', 6'', 6''', $\mathbf{6}^{IV}$, $\mathbf{6}^{V}$ to hold or connect said fixing part onto said display units.

By making the label supports uniform, a uniform presentation of the labeling throughout the store is made possible. Also uniform labeling facilitates the use of word processors and label stocks can be reduced. By standardizing the manner of fitting onto the fixing part, stocks of label holders can be reduced; the same practice also means that the label holders can be collected together and distributed around the store without worrying whether they will fit the various display units since the fixing parts can stay in position. At one and the same time, therefore, it is possible to improve shelf presentation, and to reduce labor costs and stocks of spare parts by using a set of devices according to the present invention which comprises a plurality of identical label holders and a set of different fixing parts corresponding to the whole collection of different display units in the store, said set of devices giving a unified appearance to the labeling of the whole collection on the display units.

According to a first embodiment of the present invention, the dimensions of the label support, of the order of size of the labels, are such that a single fixing part is sufficient to hold it in place. Viewed from the front, it is advantageously of square or not very long rectangular shape, although other easily made shapes (circular, oval) are usable, without departing from the scope of the present invention. It normally contains one or a small number of labels.

According to a second embodiment of the present invention, as the label support is of elongate shape, in the general shape of a bar the length of which is of the order of magnitude of the length of the display unit. Two or more fixing parts hold it in place in front of a shelf, or on two or more rods or bars, or in front of a presentation wall, on which goods are hung. It may contain a plurality of labels or any other written information.

According a preferred embodiment of the present invention, the second standardized means of assembly of the fixing part and its means of fixing to the display units are connected in such a way that the plane in which the label lies is slightly inclined upwards or downwards from the vertical. This enables the label to be turned towards the eye of the consumer as he stands in front of the display unit, whatever the height of this unit.

The label holder according to the present invention can be made from many materials, moldable, extrudable or machinable, in particular from plastic.

According to a preferred embodiment of the present invention, it is made of transparent or colored plastic, known per se, and comprises a transparent front wall 2, 2' covering the label and protecting it from damage.

The fixing parts are made of plastic or any other moldable, extrudable or machinable material. According to a preferred embodiment of the present invention, the fixing part or at the very least its means of fixing to the display units is made of a semi-rigid material which will accept slight deformation in order to adapt to variations in sizes of the display units.

To reduce the cost of manufacture and facilitate the handling of the label holder with respect to the fixing parts, it is preferable to make the label-holder device of the present invention in the form of parts having the same profile.

Other advantages and properties of the label-holder device according to the present invention will be seen more clearly with the aid of the examples given herebelow purely by way of illustration and not limitation, and with the accompanying figures.

DETAILED DESCRIPTION OF THE INVENTION

Figure 1:
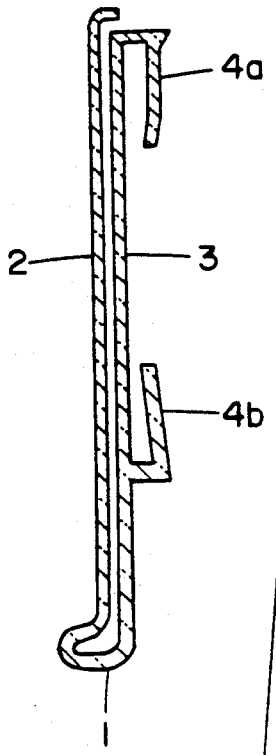
FIG. 1 is a cross-sectional view of the label support of the present invention.

FIG. 1 shows a sectional view of the label holder 1. The label holder 1 has a semi-rigid transparent face 2 and is made of transparent plastic.

The label holder 1 is shown as being one-piece with a back support 3 spaced from the face. The face and back support are sized to hold a label therebetween and have a profile of a planar pocket to hold or clamp a label therebetween.

The back support has a first assembly extending from the backside of the back support 3 in the form of two oppositely facing strips 4*a* and 4*b* spaced from the backside to provide means for slidably holding the second assembly 5. The second assembly is a standardized part in the form of a plate 5, 5', 5'' and 5$^{V}$ as is shown in FIGS. 3, 4, 5, 6 and 8.

Figures 2, 8:
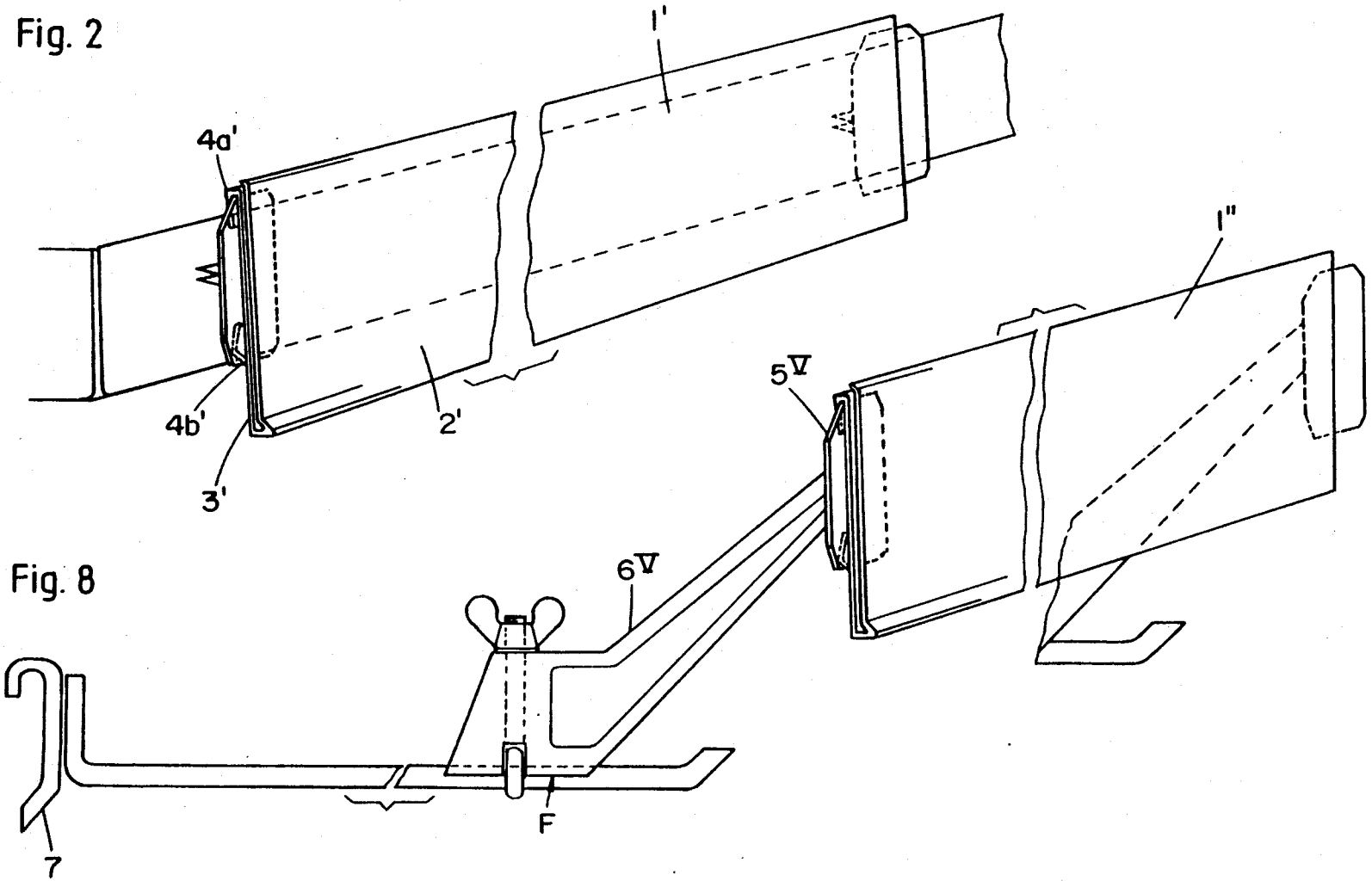
FIG. 2 is a partial perspective view of the label holder system of the present invention.
FIG. 8 is a partial perspective view of a further label holder system according to the present invention.

FIG. 2 shows an elongate label support 1' held against the edge of a shelf by two fixing parts or attachments.

Figure 3:
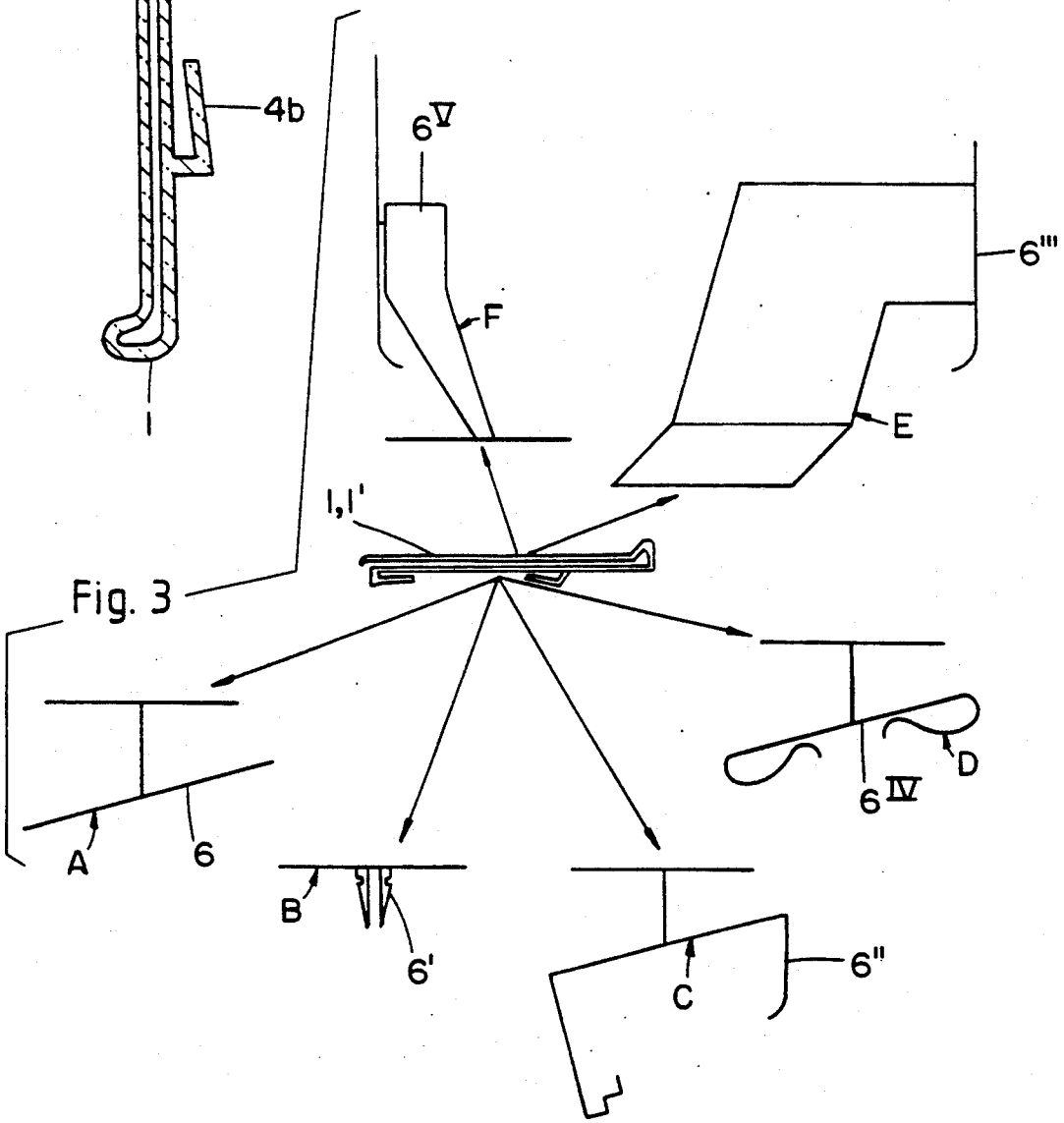
FIG. 3 is a side view of the label holder system of the present invention showing several fixing parts.

FIG. 3 shows diagrammatically how the label holder can be made to fit different attachments A, B, C, D, E. Drawing 3D shows diagrammatically a fixing part intended to be hung on a rod, for example on a display tray.

Figure 4:
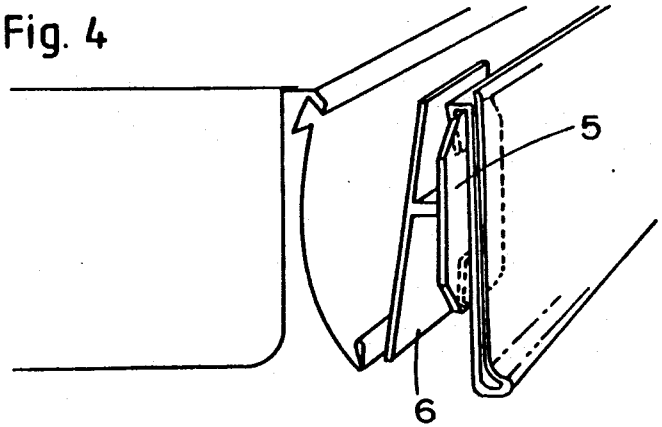
FIG. 4 is a partial perspective view of the label holder system of the present invention using one of the fixing parts of FIG. 3.

FIG. 4 shows a second attachment or fixing part (shown diagrammatically by drawing 3A) in which the label holder can be fixed to a shelf edge rail. The second attachment has a second fixing means 6 with the upper and lower edges that engage in the grooves of the rail. The fixing means is in the form of a plate 6 which can be cut back if necessary to fit the width of this rail.

Figure 5:
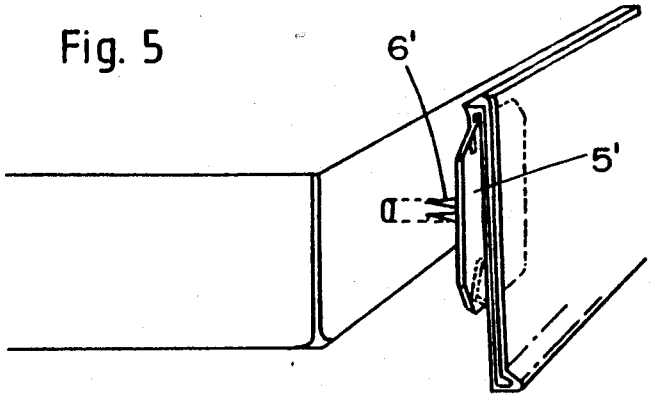
FIG. 5 is another partial perspective view of the label holder system of FIG. 2.

FIG. 5 shows a shelf provided with holes in its edge. The second attachment has the plate 5' and a second fixing means extending from the plate in the form of a pin 6' which engages in a hole. This pin 6' can be conical and split as shown in drawing B (FIG. 3) or threaded.

Figure 6:
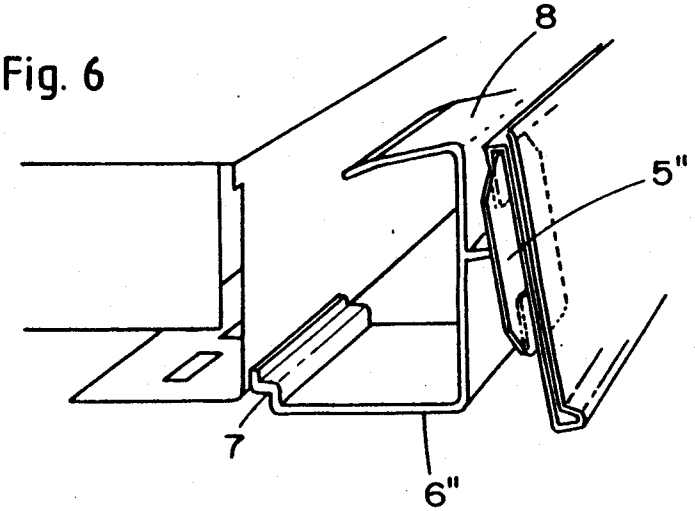
FIG. 6 is a partial perspective view of another label holder system according to the present invention.

FIG. 6 shows a second fixing means intended to fit shelves whose edge is in the shape of an angle bar. The part 7 engages with the lower rearmost extremity of the angle bar. The top part 8, which is inclined and semi-rigid, adapts itself to the upper edge of the shelf, allowing a certain tolerance in the shelf thickness.

Figure 7:
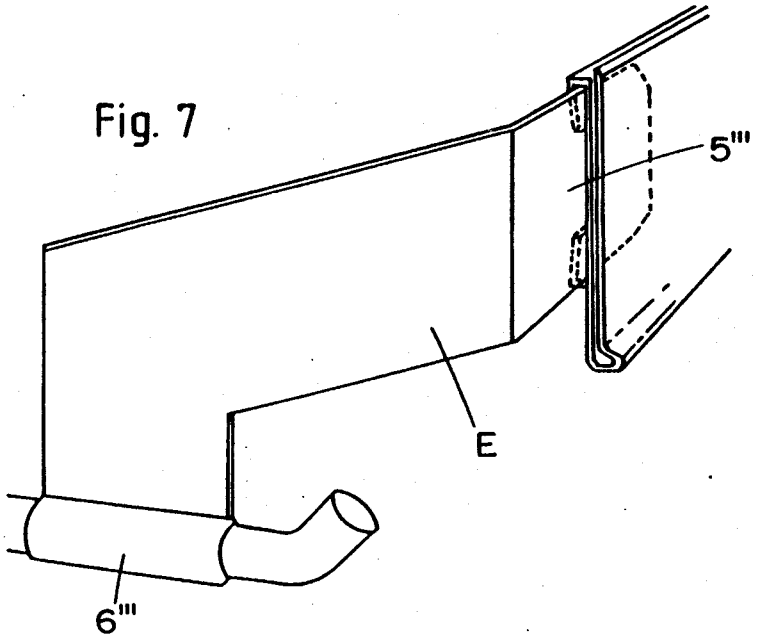
FIG. 7 is a partial perspective view of still another label holder system according to the present invention.

FIG. 7 shows a first fixing means intended for display units in the form of rods from which the goods are hung with the aid of hangers.

FIG. 8 shows another embodiment F of a first fixing part. It has a molded plastic part, the lower edge of which is grooved in the form of a portion of a cylinder, in which a rod or bar slides. Said rod may be part of the goods display unit, or may equally well be supplied as part of F, allowing the label holder 1'' to be positioned at a variable distance from a panel or shelf, by attaching the rod thereto by other fixing means 7, shown diagrammatically on the left of FIG. 8. The rod is held firmly in place and clamped to the plastic part, by an inner pin one end of which is a ring in which the rod is held and the other end of which is threaded, provided with a wing nut which, by screwing, draws the pin in towards the plastic part and clamps the pin against the plastic part.

The above embodiments and the figures corresponding to them are given solely by way of illustration. Many variations may be made by those skilled in the art without departing from the field of the present invention.

I claim:

1. A label holder system for a plurality of different display units, said display units including shelves and rods, the system comprising:

a universal label holder, said label holder being a one-piece sectional plastic having a face spaced from a back support, said face being a semi-rigid transparent part, said face and back support being sized to hold a label therebetween, and said face and said back support having a profile of a planar pocket holding the label between said face and said back support, a first assembly means extending from a backside of said back support, a first and second attachment means, said first and second attachment means having extending from one end thereof a second assembly means, said second assembly means being attachable to said first assembly means to attach said first or second attachment means to said label holder and said first assembly means fitting the second assembly means by interlocking and lateral sliding of their corresponding surfaces, a first fixing means extending from another end of said first attachment means, said first fixing means being attached to a first display unit in form of a rod, a second fixing means extending from another end of said second attachment means, said second fixing means being different than said first fixing means, said second fixing means being attached to an edge rail of a second display unit in form of a shelf wherein said label holder may be used with a plurality of different display units in such a way that said face is turned towards the eye of the observer.

2. The system as claimed in claim 1 wherein said face and back support form an elongated label support and said first assembly means is attachable simultaneously to two or more attachment means.

3. A label holder system for a plurality of different display units, said display units including shelves and rods, the system comprising:

a universal label holder, said label holder being a one-piece sectional plastic having a face spaced from a back support, said face being a semi-rigid transparent part, said face and back support being sized to hold a label therebetween, and said face and said back support having a profile of a planar pocket holding the label between said face and said back support, a first assembly means extending from a backside of said back support, a first and second attachment means, said first and second attachment means having extending from one end thereof a second assembly means, said second assembly means being attachable to said first assembly means to attach said first or second attachment means to said label holder and said first assembly means fitting the second assembly means by interlocking and lateral sliding of their corresponding surfaces, a first fixing means extending from another end of said first attachment means, said first fixing means is attachable to a first display unit in the form of a rod by means of an inner pin one end of which is a ring in which the rod is held and the other end of which is threaded and provided with a wing nut, the said first attachment means being comprised of a molded plastic part, a lower edge of which is grooved for slidably accommodating the said rod, the said rod being firmly held in place and clamped to said plastic part by screwing the said wing nut a second fixing means extending from another end of said second attachment means, said second fixing means being different than said first fixing means, said second fixing means being attachable to an edge rail of a second display unit in form of a shelf wherein said label holder may be used with a plurality of different display units in such a way that said face is turned towards the eye of the observer.

4. The system as claimed in claim 3, wherein said second fixing means is formed as semi-rigid parts clipable on to corresponding surfaces of a shelf edge.

5. The system as claimed in claim 4 wherein said face and back support form an elongated label support, said first assembly means is attachable simultaneously to two or more attachment means.

6. The system as claimed in claim 4, further comprising a third attachment means, said third attachment means having extending from one end thereof, said second assembly means and a third fixing means, extending from another end of said third attachment means, said third fixing means being attachable to a hole in the edge of a shelf.

7. The system as claimed in claim 6 wherein said face and back support form an elongated label support and said first assembly means is attachable simultaneously to two or more attachment means.

8. The system as claimed in claim 3 wherein said face and back support form an elongated label support and said first assembly means is attachable simultaneously to two or more attachment means.

* * * * *

UNITED STATES PATENT AND TRADEMARK OFFICE

CERTIFICATE OF CORRECTION

PATENT NO. : 5,197,215
DATED : March 30, 1993
INVENTOR(S) : Jorgen F. Torsleff

It is certified that error appears in the above-indentified patent and that said Letters Patent is hereby corrected as shown below:

On the Title page, item [73], Assignee: should read --Label Plastic Holder International Ltd., Tortola, Virgin Islands--.

Signed and Sealed this

Twenty-eighth Day of June, 1994

*Attest:*

Bruce Lehman

BRUCE LEHMAN

*Attesting Officer*

*Commissioner of Patents and Trademarks*